US005218811A

United States Patent [19]

LaPlante et al.

[11] Patent Number: 5,218,811

[45] Date of Patent: Jun. 15, 1993

[54] CLOSURE PRE-TIGHTENING MECHANISM FOR A CONTAINER FILLING AND CAPPING SYSTEM

[75] Inventors: John F. LaPlante, Bowling Green; John A. Louy, Waterville, both of Ohio

[73] Assignee: Diversified Capping Equipment, Inc., Perrysburg, Ohio

[21] Appl. No.: 889,158

[22] Filed: May 27, 1992

[51] Int. Cl.[5] ..... B67B 3/20; B65B 7/28

[52] U.S. Cl. ..... 53/331.5

[58] Field of Search ..... 53/331.5, 314, 317, 53/490, 306, 308, 310, 311, 315, 367

[56] References Cited

U.S. PATENT DOCUMENTS

| | | | |
|---|---|---|---|
| 3,124,916 | 3/1964 | Anderson et al. | 53/314 X |
| 3,184,897 | 5/1965 | Shriner et al. | 53/331.5 |
| 3,559,365 | 2/1971 | Hull et al. . | |
| 3,874,147 | 4/1975 | Zetterberg | 53/314 |
| 3,908,341 | 9/1975 | Conti | 53/314 |
| 4,308,707 | 1/1982 | Willingham | 53/331.5 X |
| 4,608,806 | 9/1986 | Haslam et al. | 53/317 X |
| 4,663,913 | 5/1987 | Trendel | 53/331.5 X |
| 4,840,014 | 6/1989 | Takehana et al. | 53/432 |
| 4,922,684 | 5/1990 | Nelson | 53/331.5 X |
| 4,939,890 | 7/1990 | Peronek et al. | 53/331.5 X |
| 5,012,630 | 5/1991 | Ingram et al. | 53/331.5 X |
| 5,054,268 | 10/1991 | Hayes et al. | 53/490 |

*Primary Examiner*—Horace M. Culver

*Attorney, Agent, or Firm*—MacMillan, Sobanski & Todd

[57] ABSTRACT

A mechanism for pre-tightening closures on containers in a container filling and capping system is disclosed. The closure pre-tightening mechanism includes a hold down plate for exerting a downwardly directed force against closures which are loosely deposited upon the containers by a closure applying mechanism. The hold down plate is supported in a floating manner, permitting pivoting or other transverse movement to accommodate misalignment with the containers. A vertically serrated rail is provided on the lower surface of the hold down plate for engaging the outer surfaces of the closures and rotating them relative to the containers. A reaction rail is also provided on the lower surface of the hold down plate for engaging the opposed outer surfaces of the closures while they are engaged with the serrated rail. Either or both of the serrated rail and the reaction rail may be resiliently mounted on the hold down plate so as to exert a predetermined amount of force against the closure to rotate it relative to the container.

20 Claims, 4 Drawing Sheets

CLOSURE PRE-TIGHTENING MECHANISM FOR A CONTAINER FILLING AND CAPPING SYSTEM

BACKGROUND OF THE INVENTION

This invention relates in general to systems for filling and capping containers. In particular, this invention relates to an improved apparatus for applying threaded plastic closures formed having tamper evident bands which inhibit the application of such closures to the containers.

Many systems are known for filling containers with a product, such as a liquid, and for applying closures thereto. Typically, the containers are embodied as glass or plastic bottles having reduced diameter threaded neck portions, and the closures are embodied as threaded plastic or similar closures. Empty containers are sequentially fed through a filling machine, wherein they are filled with the product. Then, the filled containers are fed through a capping machine, wherein the closures are applied thereto. The capping machine includes both a closure application mechanism (for loosely depositing the closures on the containers) and a closure tightening mechanism (for rotating the closures relative to the containers to secure them thereon). Closure application and tightening mechanisms are well known in the art and have functioned satisfactorily with many standard closures.

More recently, however, there has been an emphasis placed on utilizing closures which have bands or similar structures formed thereon which provide a visual indication of unauthorized tampering. It has been found that the tamper evident structure formed on the closure makes it more difficult to thread the closure onto the container. Thus, many capping machines are now provided with a closure pre-tightening mechanism disposed between the closure application mechanism and the closure tightening mechanism. These pre-tightening mechanisms are adapted to tightly engage the loosely deposited closure and rotate it a small amount relative to the container to insure that the mating threaded portions thereof properly engage one another. Once this has occurred, the container carrying the pre-tightened closure is fed to the closure tightening mechanism for final tightening.

Closure pre-tightening mechanisms are known in the art. However, as more sophisticated tamper evident closure structures have been developed, it has been found that they further resist pre-tightening rotation relative to the containers. Specifically, such closures have increased band engagement beneath the annular bead on the neck of the container. The flange is more rigid and has a greatly reduced inner diameter which interferes with the container finish and makes the threaded engagement during the pre-tightening portion of the system more difficult. Thus, existing closure pre-tightening mechanisms are unable to adequately perform their intended function with these newer closures.

It has been found to be unsatisfactory to simply increase the magnitude of the frictional engagement exerted by known closure pre-tightening mechanisms to overcome the problems associated with the newer closures. This is because the greater forces applied to the outer surfaces of the closures tend to scrape or otherwise mar such surfaces with undesirable marks. Also, such forces will tilt the container, thus preventing the closure from becoming properly threaded thereon. Thus, it would be desirable to provide an improved structure for a closure pre-tightening mechanism for a container filling and capping machine which is capable for use with more sophisticated tamper evident closure structures.

SUMMARY OF THE INVENTION

This invention relates to an improved mechanism for pre-tightening closures on containers in a container filling and capping system. The closure pre-tightening mechanism includes a hold down plate for exerting a downwardly directed force against closures which are loosely deposited upon the containers by a closure applying mechanism. The hold down plate is supported in a floating manner, permitting pivoting or other transverse movement to accommodate misalignment with the containers. A vertically serrated rail is provided on the lower surface of the hold down plate for engaging the outer surfaces of the closures and rotating them relative to the containers. A reaction rail is also provided on the lower surface of the hold down plate for engaging the opposed outer surfaces of the closures while they are engaged with the serrated rail. Either or both of the serrated rail and the reaction rail may be resiliently mounted on the hold down plate so as to exert a predetermined amount of force against the closure to rotate it relative to the container.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
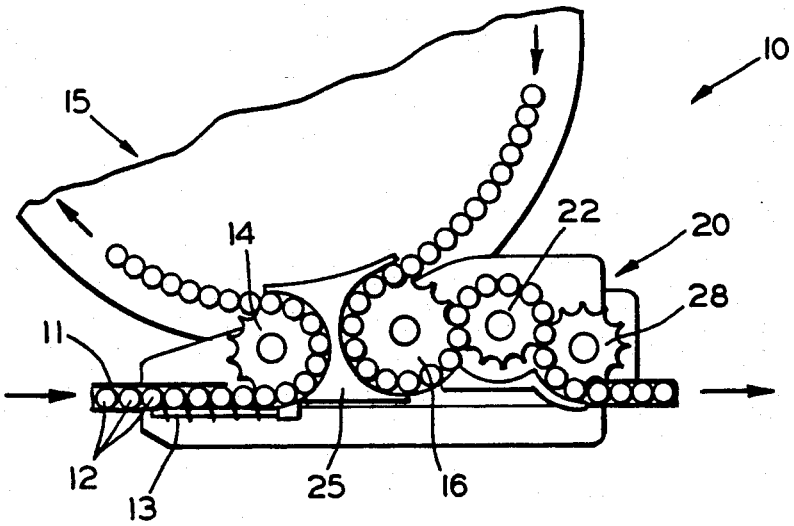
FIG. 1 is a schematic top plan view of a portion of a container filling and capping system in accordance with this invention.
Figure 2:
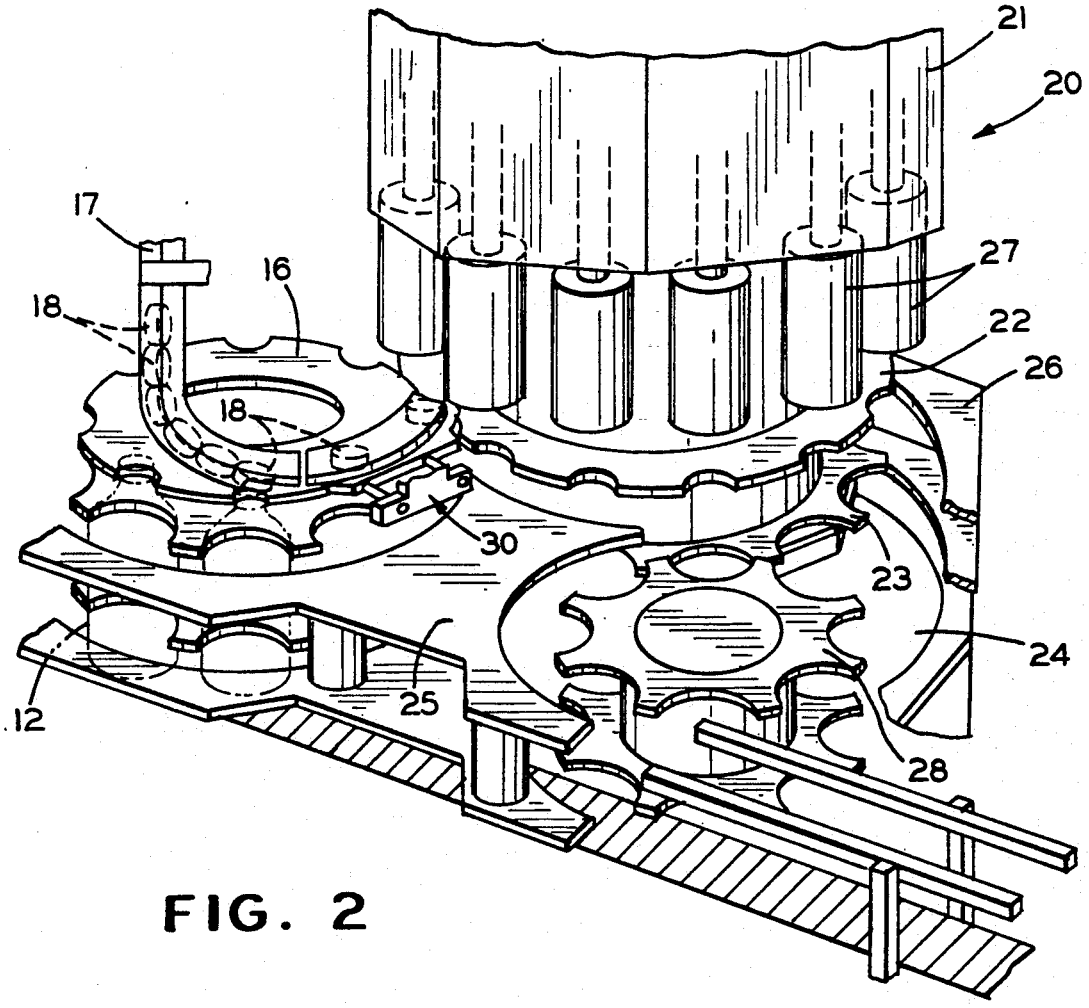
FIG. 2 is a perspective view of a portion of the filling machine of the container filling and capping system illustrated in FIG. 1.

Referring now to the drawings, there is illustrate in FIGS. 1 and 2 a filling and capping system, indicated generally at 10, in accordance with this invention. The system 10 includes an in-feed conveyor 11 which receives a plurality of empty containers 12 sequentially from a supply station (not shown). The containers 12 (shown in phantom in FIG. 2 for clarity) are transferred from the in-feed conveyor station 11 by an in-feed worm 13 and a filling transfer star wheel 14 to a container filling machine, indicated generally at 15.

The filling machine 15 is conventional in the art and may include a plurality of cam or pneumatically operated lifts or pedestals (not shown). These lifts raise the containers 12 up from the level of the filling transfer star wheel 14 and against filler valves (not shown) as the containers 12 are moved circumferentially about the filling machine 15. As the containers 12 are further moved circumferentially about the filling machine 15, fluid or other material is injected therein through the filler valves. After filling, the containers 12 are lowered away from filler valves by the lifts.

The filled containers 12 are transferred away from the filling machine 15 by a capping transfer star wheel 16. A closure application mechanism is provided above the capping transfer star wheel 16. As best shown in FIG. 2, the closure application mechanism includes a chute 17 containing a plurality of closures 18. The closures 18 may be embodied as conventional internally threaded plastic caps and may be of the type having a tamper evident band which resists application to the containers 12. As the containers 12 are moved circumferentially about the capping transfer star wheel 16, the closures 18 are loosely deposited on the externally threaded tops thereof. The structure and operation of the closure application mechanism is conventional in the art and forms no part of this invention.

A closure pre-tightening mechanism, indicated generally at 30 in FIG. 2, is also provided above the capping transfer star wheel 16. The structure and operation of the closure pre-tightening mechanism 30 will be explained in detail below. Briefly, however, the closure pre-tightening mechanism 30 is provided to sequentially engage the loosely deposited closures 18 and rotate them a small amount relative to their associated containers 12. As discussed above, this pre-tightening is done to insure that the threaded portions of the containers 12 and the closures 18 begin to engage one another. The closure pre-tightening mechanism 30 is generally required when the closures 18 have tamper evident bands or similar structures formed thereon.

The containers 12 having the pre-tightened closures 18 partially threaded thereon are then moved into a capping machine, indicated generally at 20. As best shown in FIG. 2, the capping machine 20 includes an upper capping turret 21, a pair of intermediate capping star wheels 22 and 23, and a lower capping table 24. The capping turret 21, the capping star wheels 22 and 23, and the capping table 24 rotate together as a unit. The containers 12 are supported on the capping table 24 for circumferential movement about the capping machine 20. The capping star wheels 22 and 23 provide lateral support to the side walls and necks of the containers 12 as they are so moved. Also, guide rails 25 and 26 may be provided to retain the containers 12 within the outwardly facing openings of the capping star wheels 22 and 23.

A plurality of capping heads 27 are mounted on the capping turret 21 for rotation therewith. The capping heads 27 are conventional in the art and may be embodied as torque motors or similar devices. The capping heads 27 engage and rotate the pre-tightened closures 18 relative to the associated containers 12 so as to apply them securely thereto. After the closures 18 are fully tightened, the containers 12 are fed out of the system 10 by a out-feed star wheel 28 to a packaging conveyor (not shown) or other conventional device.

Figure 3:
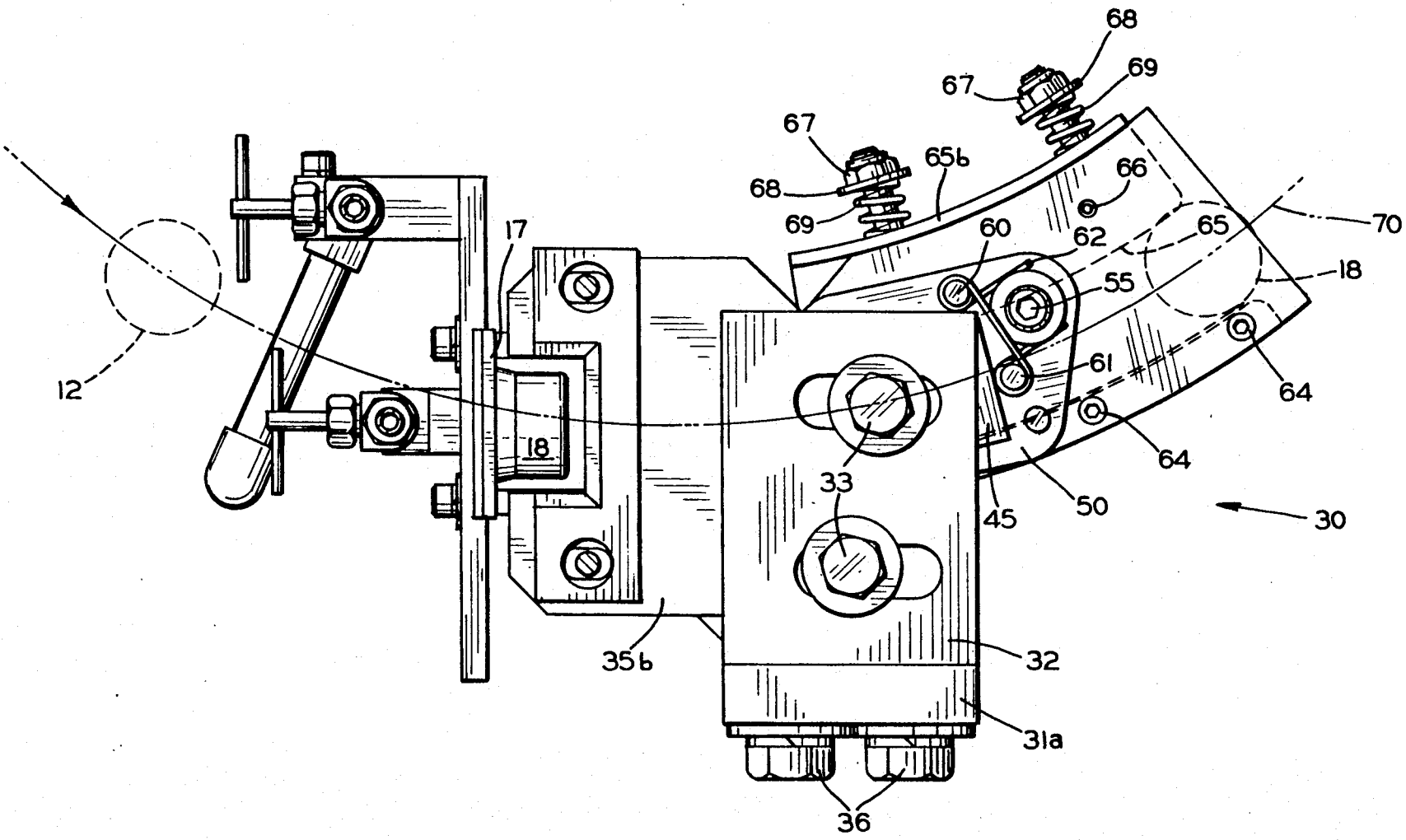
FIG. 3 is a top plan view of a closure pre-tightening mechanism for the container filling and capping system illustrated in FIGS. 1 and 2.
Figure 4:
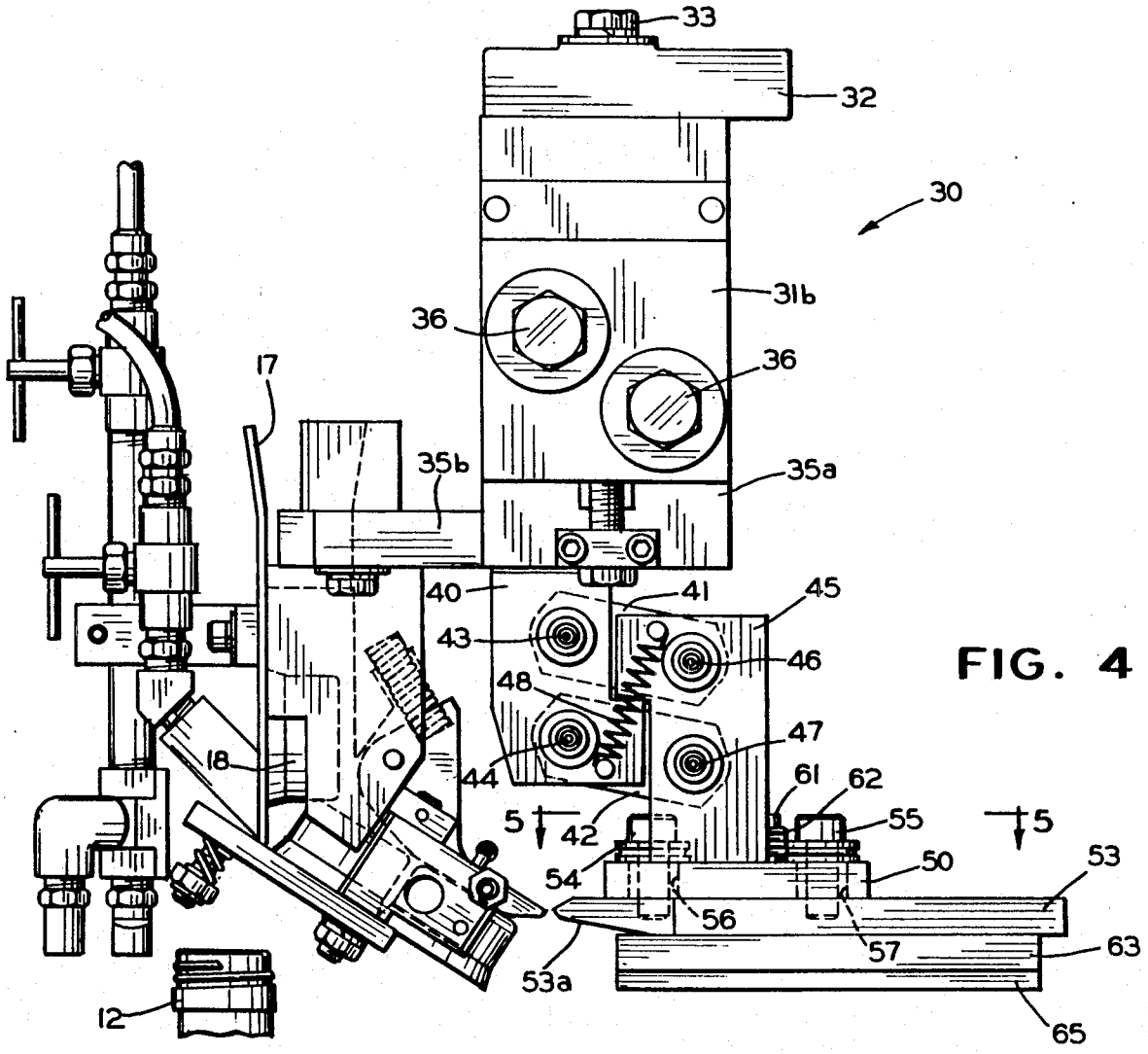
FIG. 4 is a side elevational view of the closure pre-tightening mechanism FIG. 3.

Referring now to FIGS. 3 through 6, the structure of the closure pre-tightening mechanism 30 is illustrated in detail. FIGS. 3 and 4 show the support structure for the closure pre-tightening mechanism 30. Such support structure includes an upper L-shaped bracket having a horizontally extending leg 31*a* and a vertically extending leg 31*b*. The horizontally extending leg 31*a* is secured to a portion of a frame 32 for the container filling and capping apparatus 10 by a pair of threaded fasteners 33. The support structure further includes a lower generally L-shaped bracket having a vertically extending leg 35*a* and a horizontally extending leg 35*b*. The vertically extending leg 35*a* of the lower L-shaped bracket is secured to the vertically extending leg 31*b* of the upper bracket by a pair of threaded fasteners 36. The horizontally extending leg 35*b* of the lower bracket provides a mounting surface for the various components of the closure pre-tightening mechanism 30.

As best shown in FIG. 4, a first hold down bracket 40 is secured to the horizontally extending leg 35*b* of the lower L-shaped bracket by a pair of threaded fasteners (not shown), extending downwardly therefrom. The first hold down bracket 40 is formed having a generally U-shaped configuration defining a pair of opposed legs. A pair of links 41 and 42 have first ends which are pivotably secured between the legs of the first hold down bracket by respective pivot pins 43 and 44. Similarly, a second hold down bracket 45 is provided, also having a generally U-shaped configuration defining a pair of opposed legs (see FIG. 5). The second ends of the links 41 and 42 are pivotably secured between the legs of the second hold down bracket 45 by respective pivot pins 46 and 47. Thus, the second hold down bracket 45 is movable upwardly and downwardly relative to the first hold down bracket 40.

First and second coiled springs 48 (only one is illustrated in FIG. 4) are secured to the opposed sides of the first and second hold down brackets 40 and 45. The coiled springs 48 are provided to exert a force urging the second hold down bracket 45 downwardly relative to the first hold down bracket 40. The purpose for this downward urging will be explained below.

Figure 5:
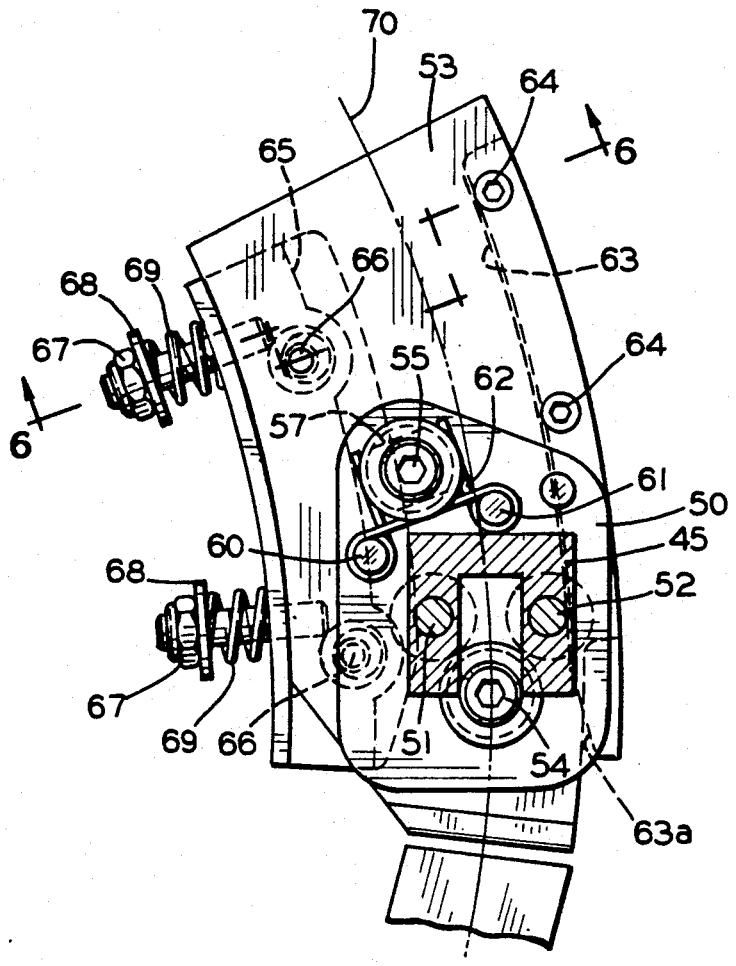
FIG. 5 is a sectional view taken along line 5—5 of FIG. 4.

A mounting bracket 50 is secured to the lower end of the second hold down bracket 45 by a pair of threaded fasteners 51 and 52 (see FIG. 5). Thus, the mounting bracket 50 is fixed in position relative to the second hold down bracket 45. A hold down plate 53 is pivotably secured to the lower surface of the mounting bracket 50 by first and second threaded fasteners 54 and 55. The first threaded fastener 54 extends through a bushing disposed within a bore 56 formed through the mounting bracket 50 and into a threaded aperture formed in the hold down plate 53. The second threaded fastener 55 extends through a bushing disposed within a transverse slot 57 formed through the mounting bracket 50 and into a threaded aperture formed in the hold down plate 53.

The hold down plate 53 pivots about the first threaded fastener 54. Such pivoting movement is limited by the travel of the second threaded fastener 55 throughout the slot 57. If desired, the positions of the bore 56 and the slot 57 may be reversed. Alternatively, the bore 56 may be replaced by a second slot, permitting both ends of the hold down plate 53 to move relative to the mounting bracket 50. The lower surface of the forward end of the hold down plate 53 is angled upwardly, as shown at 53*a* in FIG. 4. The purpose for this angled surface 53*a* will be described below.

Because the hold down plate 53 is movable relative to the mounting bracket 50, a mechanism is provided for normally maintaining the hold down plate 53 in a predetermined position relative to the mounting bracket 50. To accomplish this, a pair of upstanding posts 60 and 61 are provided on the mounting bracket 50 (best shown in FIG. 5). A wire spring 62 is wound about the posts 60 and 61, having leg portions which extend about the opposed sides of the second threaded fastener 55. The leg portions of the wire spring 62 engage the second threaded fastener 55, urging it (and the hold down plate 53 secured thereto) toward a centered position relative to the mounting bracket 50. Thus, if a force is exerted against the hold down plate 53 causing it to pivot relative to the mounting bracket 50, the wire spring 62 will return the hold down plate 53 to its centered position when that force is removed. The wire spring 62 also functions to dampen oscillations of the hold down plate 53 during use.

Figure 6:
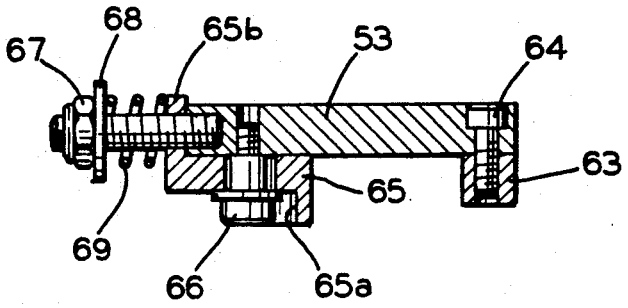
FIG. 6 is a sectional view taken along line 6—6 of FIG. 5.

As best shown in FIGS. 5 and 6, an outer rail 63 is secured to the lower surface of the hold down plate 53 by a plurality of threaded fasteners 64. The outer rail 63 extends in an arcuate manner beneath the hold down plate 53. Preferably, the inner surface of the outer rail 63 is formed having a plurality of vertical serrations. The inner surface of the forward end of the outer rail 63 is angled inwardly, as shown at 63*a* in FIG. 5. The purpose for the outer rail 63 and for its angled surface 63*a* will be explained below.

An inner rail 65 is also carried on the hold down plate 53. As best shown in FIG. 6, the inner rail 65 is secured to the lower surface of the hold down plate 53 by a plurality of threaded fasteners 66 (only one of which is illustrated). The threaded fasteners 66 extend through respective transverse slots 65*a* formed through the inner rail 65. Thus, the inner rail 65 is transversely movable (i.e., toward the left and right when viewing FIG. 6) relative to the hold down plate 53.

Because the inner rail 65 is movable relative to the hold down plate 53, a mechanism is provided for normally maintaining the inner rail 65 in a predetermined position relative to the hold down plate 53. To accomplish this, the inner rail 65 is provided with an upstanding arcuate flange portion 65*b* which extends upwardly adjacent the inner side of the hold down plate 53. A plurality of threaded studs 67 (each having a nut threaded thereon) extend through respective bores formed through the flange portion 65*b* of the inner rail 65 into threaded apertures formed in the side of the hold down plate 53. Each of the threaded studs 67 is provided with a washer 68 or, alternatively, an enlarged portion of the nut. A coiled spring 69 is disposed concentrically about the shank of each of the threaded studs 67. The coiled springs 69 react against the washers 68 and the sides of the flange portion 65*b* of the inner rail 65. As a result, the inner rail 65 is urged outwardly toward the outer rail 63.

In operation, empty containers 12 are fed through the in-feed conveyor 11, the in-feed worm 13, and the filling transfer star wheel 14 to the filling machine 15. The filling machine 15 fills the containers 12 with the liquid product, as described above. Then, the filled containers 12 are fed through the capping transfer star wheel 16 to the closure application mechanism. Closures 18 are picked up by the containers 12 as they move past the lower end of the chute 17. As previously discussed, these closures 18 are only loosely deposited on the containers 12 by the chute 18.

Referring to FIG. 4, the containers 12 carrying the loosely deposited closures 18 are then introduced into the closure pre-tightening mechanism 30. The closure 18 is initially engaged by the angled surface 53*a* of the hold down plate 53. As discussed above, the hold down plate 53 is vertically movable by virtue of the pivoted connection between the first and second hold down brackets 40 and 45. Thus, the closure 18 engages the hold down plate 53 and raises it upwardly slightly against the urging of the coiled springs 48. In this manner, the hold down plate 53 exerts a downwardly directed force against the closure 18, holding it firmly against the upper end of the container 12. Also, the hold down plate 53 prevents the closure 18 from becoming tilted relative to the container 12, insuring that their rotational axes are co-axially aligned.

Referring to FIG. 5, the containers 12 and the closures 18 carried thereon are moved beneath the hold down plate 53 along a path indicated by the line 70. Ideally, the paths of all of the containers 12 coincide exactly with the line 70. However, because of manufacturing tolerances in both the closure pre-tightening mechanism 30 and in the containers 12 themselves, the closures 18 often deviate laterally from the line 70. To compensate for this, the hold down plate 53 floats relative to the mounting bracket 50 to which it is secured. As discussed above, the illustrated embodiment of the hold down plate 53 is pivotable relative to the mounting bracket 50 about the first threaded fastener 54. Thus, if the path of movement of a particular container 12 and its associated closure 18 deviates from the line 70, the hold down plate 53 will pivot to accommodate such movement. Thus, the closure 18 will not be damaged as it passes through the closure pre-tightening mechanism 30.

As the closure 18 is moved beneath the hold down plate 53, the sides thereof are engaged by the outer rail 63 and the inner rail 65. The closure 18 is initially engaged by the angled surface 63*a* of the outer rail 63 to insure that it enters smoothly between the outer and inner rails 63 and 65. As discussed above, the outer rail 63 is formed having a plurality of vertical serrations. These serrations are provided to frictionally engage the outer surface of the closure 18 (which is typically formed having similar vertical serrations to facilitate subsequent removal by a consumer). The surface of the inner rail 65 is smooth, thus providing a reaction surface for the closure 18 and the outer rail 63. As the container 12 (which is prevented from rotating by conventional means provided on the capping transfer star wheel 16) is moved past the stationary outer rail 63, the closure 18 is rotated relative thereto (clockwise when viewing FIG. 5). Thus, the closures 18 are pre-tightened onto the containers 12.

As discussed above, the inner rail 65 is resiliently urged outwardly toward the outer rail 63. Preferably, the transverse distance separating the inner rail 65 from the outer rail 63 is slightly less than the diameter of the closure 18. Thus, when the closure 18 is moved along the line 70 between the outer and inner rails 63 and 65, the inner rail 65 is moved inwardly (i.e., away from the outer rail 63) against the urging of the springs 69. In this manner, a predetermined amount of force is exerted against the outer surface of the closure 18 by the outer and inner rails 63 and 65. As a result, the closure 18 is pre-tightened onto the container 12. Following this, the container 12 carrying the pre-tightened closure 18 is fed into the capping machine 20 for final tightening.

It will be appreciated that several variations of the closure pre-tightening mechanism 20 may be desirable for specific applications. If, for example, it is desired to rotate the closure 18 in the opposite direction relative to the container 12 (counter-clockwise when viewing FIG. 5), then the vertical serrations may be provided on the inner rail 65 instead of the outer rail 63. Also, the outer rail 63 may be resiliently mounted on the hold down plate 53 similar to the manner shown for the inner rail 65. Thus, the outer rail 63 may resiliently engage the closures 18 in addition to (or in lieu of) the inner rail 65. Lastly, as mentioned above, the hold down plate 53 may be pivoted about the second threaded fastener 55 instead of the first threaded fastener 54. Alternatively, the hold down plate 53 may be transversely movable relative to the mounting bracket 50 by both of the threaded fasteners 54 and 55, instead of only the first threaded fastener 54.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. An apparatus for rotating a closure deposited on a container relative to the container as the container and the closure are moved along a predetermined path, said apparatus comprising:

a bracket;

a plate mounted on said bracket for lateral movement relative to the predetermined path; and a rail mounted on said plate and positioned such that it engages a portion of the closure as the container is moved along said predetermined path, said rail having a surface which engages the portion of the closure to cause the closure to rotate relative to the container as the container is moved along said predetermined path.

2. The invention defined in claim 1 wherein said bracket is movably mounted on said plate by first and second fasteners extending though respective first and second openings formed in said plate into engagement with said bracket.

3. The invention defined in claim 1 wherein said first opening is formed as a slot such that said bracket can pivot about said second fastener relative to said plate.

4. The invention defined in claim 2 wherein both of said first and second openings are formed as slots such that said bracket can move transversely relative to said plate.

5. The invention defined in claim 1 further including means for urging said bracket toward a predetermined position relative to said plate.

6. The invention defined in claim 5 wherein said bracket is movably mounted on said plate by a fastener extending through an opening formed in said plate into engagement with said bracket, and further wherein said means for urging includes means mounted on said plate for resiliently engaging said fastener so as to urge it and said bracket toward said predetermined position.

7. The invention defined in claim 6 wherein said means mounted on said plate for resiliently engaging said fastener includes a post formed on said plate and a spring extending between said post and said fastener.

8. The invention defined in claim 6 wherein said means mounted on said plate for resiliently engaging said fastener includes a pair of posts formed on said plate and a spring extending between said posts and said fastener.

9. The invention defined in claim 1 further including a second rail mounted on said plate and positioned such that it engages a second portion of the closure as the container is moved along said predetermined path.

10. The invention defined in claim 9 wherein one of said first and second rails is movable relative to said bracket.

11. The invention defined in claim 10 wherein said one of said first and second rails is provided with first and second ends, and wherein one of said first and second ends is movable relative to said bracket.

12. The invention defined in claim 11 further including means for resiliently urging said one of said first and second ends toward a predetermined position relative to said bracket so as to engage the associated portion of the closure.

13. The invention defined in claim 10 wherein said one of said first and second rails is provided with first and second ends, and wherein both of said first and second ends are movable relative to said bracket.

14. The invention defined in claim 13 further including means for resiliently during both of said first and second ends toward a predetermined position relative to sad bracket so as to engage the associated portion of the closure.

15. The invention defined in claim 9 wherein both of said first and second rails are movable relative to said bracket.

16. The invention defined in claim 15 wherein both of said first and second rails are provided with firs and second ends, and wherein one of said first and second ends of each of said first and second rails is movable relative to said bracket.

17. The invention defined in claim 16 further including means for resiliently urging said one of said first and second ends of each of said first and second rails toward a predetermined position relative to said bracket so as to engage the associated portion of the closure.

18. The invention defined in claim 15 wherein both of said first and second rails are provided with first and second ends, and wherein both of said first and second end of each of said first and second rails are movable relative to said bracket.

19. The invention defined in claim 18 further including means for resiliently urging both of said first and second ends of each of said first and second rails toward a predetermined position relative to said bracket so as to engage the associated portions of the closure.

20. The invention defined in claim 9 wherein one of said first and second rails has a surface which substantially frictionally engages the closure and the other of said first and second rails has a surface which does not substantially frictionally engage the closure to permit the closure to rotate relative to the container as the container is moved along said predetermined path.

* * * * *

UNITED STATES PATENT AND TRADEMARK OFFICE

CERTIFICATE OF CORRECTION

PATENT NO. : 5,218,811
DATED : June 15, 1993
INVENTOR(S) : John F. LaPlante, et. al.

It is certified that error appears in the above-indentified patent and that said Letters Patent is hereby corrected as shown below:

Column 7, Claim 3, line 1, after "claim", change "1" to --2--.
Column 8, Claim 14, line 2, after "resiliently", change "during" to --urging --.
Column 8, Claim 14, line 4, change "sad" to --said--.
Column 8, Claim 14, line 4, after "associated", change "portion" to --portions--.
Column 8, Claim 16, line 2, after "with", change "firs" to --first--.
Column 8, Claim 18, line 4, change "end" to --ends--.

Signed and Sealed this

Eleventh Day of January, 1994

Bruce Lehman

*Attest:*

BRUCE LEHMAN

*Attesting Officer*

*Commissioner of Patents and Trademarks*